US007339532B2

(12) United States Patent
Park et al.

(10) Patent No.: US 7,339,532 B2
(45) Date of Patent: Mar. 4, 2008

(54) ANTENNA MODULE AND ELECTRONIC DEVICE USING THE SAME

(75) Inventors: Il Hwan Park, Kyungki-do (KR); Chul Ho Kim, Kyungki-do (KR); Gi Tae Do, Kyungki-do (KR); Duk Woo Lee, Kyungki-do (KR); Jeong Sik Seo, Daejeon (KR); Tae Sung Kim, Seoul (KR); Sae Won Oh, Kyungki-do (KR); Hyun Hak Kim, Kyungki-do (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 232 days.

(21) Appl. No.: 11/311,255

(22) Filed: Dec. 20, 2005

(65) Prior Publication Data

US 2006/0192712 A1 Aug. 31, 2006

(30) Foreign Application Priority Data

Feb. 25, 2005 (KR) ..... 10-2005-0016103

(51) Int. Cl.
*H01Q 1/24* (2006.01)

(52) U.S. Cl. ..... 343/702; 343/700 MS

(58) Field of Classification Search ..... 343/702, 343/700 MS, 873; 455/90, 90.3, 90.6
See application file for complete search history.

(56) References Cited

U.S. PATENT DOCUMENTS

| | | | | |
|---|---|---|---|---|
| 6,512,491 | B2 * | 1/2003 | Kanayama et al. | 343/883 |
| 6,552,686 | B2 * | 4/2003 | Ollikainen et al. | 343/700 MS |
| 6,778,139 | B2 * | 8/2004 | Suzuki et al. | 343/700 MS |
| 6,914,569 | B2 * | 7/2005 | Na | 343/702 |
| 2003/0030586 | A1 * | 2/2003 | Suzuki et al. | 343/700 MS |
| 2003/0201944 | A1 * | 10/2003 | Aikawa et al. | 343/770 |

FOREIGN PATENT DOCUMENTS

| | | |
|---|---|---|
| EP | 0 383 292 A3 | 2/1990 |
| EP | 0 762 539 A1 | 8/1996 |
| GB | 2 388 964 A | 11/2003 |
| GB | 2 417 834 A | 3/2006 |
| JP | 2003-087022 | 3/2003 |
| WO | WO 02/078123 A1 | 10/2002 |

* cited by examiner

*Primary Examiner*—Huedung Mancuso
(74) *Attorney, Agent, or Firm*—McDermott Will & Emery LLP

(57) ABSTRACT

The present invention relates to an antenna module which can minimize the occupying space in an electronic device, enhancing degrees of freedom to increase efficiency in space utilization, thereby accommodating miniaturization and multi-functionality of the electronic device, and an electronic device having the same. The antenna module includes a flexible substrate, an antenna element having a feeder part, a first fixing part, and a radiation part. The antenna module further includes a feeder line connected to the feeder part having a feeder pad, a first fixing pad connected to the first fixing part, and a pad coupling element. In the invention, signals are processed via interaction between the resonance of the current running through the feeder line to the radiation part and the resonance of the current coming into the pad coupling element.

13 Claims, 15 Drawing Sheets

ANTENNA MODULE AND ELECTRONIC DEVICE USING THE SAME

CLAIM OF PRIORITY

This application claims the benefit of Korean Patent Application No. 2005-016103 filed on Feb. 25, 2005, in the Korean Intellectual Property Office, the disclosure of which is incorporated herein by reference.

BACKGROUND OF THE INVENTION

1. Field of the Invention

The present invention relates to an antenna module provided in an electronic device with a wireless communication function. More particularly, the present invention relates to an antenna module which can minimize the occupying space in an electronic device and enhances a degree of freedom of the installation structure of the antenna module, increasing efficiency in space utilization in the electronic device, thereby accommodating miniaturization and multi-functionality of the electronic device, and an electronic device having the same.

2. Description of the Related Art

The recent advancement in the semiconductor and telecommunication technology has led to extensive use of electronic devices having a wireless communication function (hereinafter referred to as "wireless electronic devices") with enhanced mobility and portability for users, and the most representative example is mobile phones. These wireless electronic devices are developed in more light-weight and miniaturized forms in order to meet the most basic needs of portability for the users.

In addition, in order to meet the needs of the users to conveniently carry a single device having multiple functions, the current trend is to add more functions including MP3, camera, credit card, wireless contact-type transportation card to the wireless electronic device.

In accordance with the current trend, there have been researches on miniaturization of components provided in the wireless electronic devices, and the antennas for sending and receiving wireless signals are not an exception to this trend.

In a conventional wireless electronic device, an internal antenna is mostly used to minimize the product size. The internal antennas include a microstrip patch antenna, a flat inverted F-type antenna, and a chip antenna.

The microstrip patch antenna takes a form of a microstrip patch printed on a printed circuit board. On the other hand, the chip antenna is made up of a plurality of layers of diverse radiation patterns including a spiral form inside a dielectric block. The plurality of radiation patterns are electrically connected to function as an antenna having a current route corresponding to a wavelength.

As shown in FIG. 1, the flat inverted F-type antenna, includes a radiation patch 11 at a predetermined height, a feeder line 12 and a ground line 13 for applying current to a corner of the radiation patch 11. The feeder line 12 and the ground line 13 are disposed perpendicular to the radiation patch 11, and bonded to feeder and ground patterns on a substrate 10, respectively.

The radiation patch 11 can basically have a rectangular shape, and here, the rectangular planar surface of the radiation patch 11 is divided by a certain shape of slits to form a spiral shape. The shape of the radiation patch 11 may take diverse forms. In the example illustrated in FIG. 1, the radiation patch 11 has two current routes, sending and receiving the frequency signals equivalent to the electrical length of the current routes. At this time, the radiation patch 11 and the feeder and ground lines 12 and 13 may be carried by, for example, a ceramic block.

However, as shown in FIG. 1, when being installed in a wireless electronic device assembly 10, the conventional internal antenna requires a certain size or larger neutral space in order to maintain its characteristics. Therefore, the conventional internal antenna takes up a space larger than its size in the wireless electronic device. However, no matter how small the space is, it is difficult to make a space for the internal antenna in the current miniaturized and multi-functioned wireless electronic devices. Conversely, saving the space will allow further miniaturization of the wireless electronic devices, and therefore, the installation space of the antenna module needs to be reduced as much as possible.

Related to the above conventional art, Japanese Laid-Open Publication Application No. 2003-87022 discloses an antenna module having high mounting density. FIG. 2 is a perspective view illustrating the antenna proposed in the application. Referring to FIG. 2, in the above-proposed antenna module, a waveguide 24 extends from a side surface of a mounting substrate 21 with a driving circuit 23 which feeds current to an antenna module 22. The waveguide 24 is used to connect the driving circuit 23 and the antenna element 22, and is formed on a flexible hard member, so that the waveguide 24 can be folded to dispose the antenna element 22 in three dimensions. The above construction of the antenna module allows integral formation of the antenna element 22, the waveguide 24, and the mounting substrate 23, reducing the assembling steps and ensuring a degree of freedom in disposing wires and components.

However, in the above-described antenna module, when the waveguide 24 is folded vertically to install the manufactured antenna module in the wireless device, the impedance of the waveguide 24 is changed, thereby weakening the antenna characteristics.

Therefore, there have been needs for researches on an antenna module which does not take up much space and has a high degree of freedom in disposition.

SUMMARY OF THE INVENTION

The present invention has been made to solve the foregoing problems of the prior art and it is therefore an object of the present invention to provide an antenna module which can minimize occupying space in an electronic device without changing the characteristics of an antenna element, enhancing a degree of freedom of installation structure to increase efficiency in space utilization in the device, thereby accommodating miniaturization and multi-functionality of the electronic device, while securing a uniform radiation pattern in all directions, obtaining a broad bandwidth, and an electronic device having the same.

According to an aspect of the invention for realizing the object, the present invention provides an antenna module including: a substrate made of flexible non-conductive material; an antenna element, mounted at a predetermined position on the upper part of the substrate, having a feeder part at one end of the underside thereof to be supplied with current, a first fixing part at the other end of the underside thereof to fasten the antenna element to the substrate, a radiation part operating in response to the supplied current; a feeder line formed on the substrate to be connected to the feeder part of the antenna element, having a feeder pad formed at one end thereof; a first fixing pad formed on the substrate to be connected to the first fixing part of the antenna element; and a pad coupling element having at least one conductive strip line which is disposed between the feeder pad and the first fixing pad, whereby a predetermined band of signals are processed via interaction between the resonance of the current running through the feeder line to the radiation part of the antenna element and the resonance of the current coming into the pad coupling element.

The antenna module according to the present invention further includes a ground part at one end of the underside of the antenna element for grounding the antenna element, a second fixing part at the other end of the underside of the antenna element, a second fixing part at the other end of the underside of the antenna element in a position opposed to the ground part, a ground line having a ground pad at one end thereof to be connected to the ground part of the antenna element, and a second fixing pad formed in a position on the substrate where the second fixing part of the antenna element is mounted, and the pad coupling element includes at least one conductive strip line disposed between the ground pad and the second fixing pad.

According to another aspect of the invention for realizing the object, the present invention provides a wireless electric device including: an antenna module including an antenna element mounted on a substrate made of flexible material, a conductive feeder line contacting at one end a feeder part of the antenna element, a ground line contacting at one end a ground part of the antenna element, each of the conductive feeder and ground lines having a joint portion formed at the other end thereof, a conductive passive line formed in parallel with the feeder line, a fixing part formed on the substrate to fasten the antenna element to the substrate, and a coupling element disposed between the feeder line and the ground line; and an assembly of a plurality of elements constituting a circuit, supplying current via the feeder line to the antenna module, whereby the antenna module is mounted at a predetermined position of the assembly at the joint portions of the feeder line and the ground line and disposed outside of the assembly.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Figure 1:
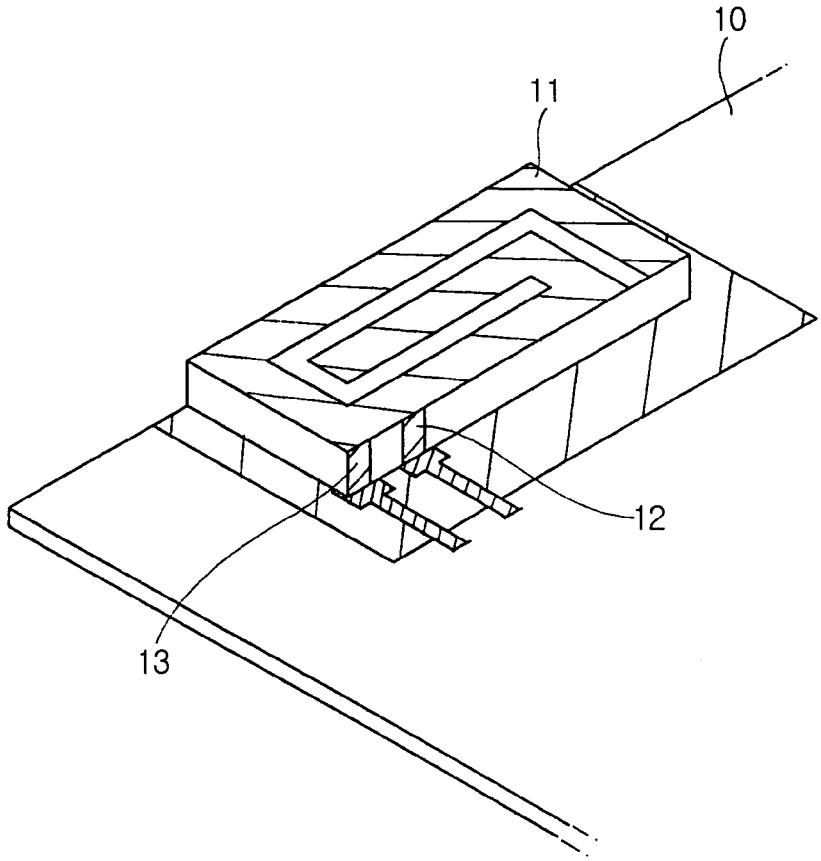
PRIOR ART FIG. 1
FIG. 1 is a perspective view illustrating a structure and installation form of a conventional internal antenna.

Preferred embodiments of the present invention will now be described in detail with reference to the accompanying drawings. It should be noted that the identical elements are designated by the same reference numerals throughout different drawings. In the following description, well-known functions and constructions are not described in detail since they would obscure the intention in unnecessary detail.

Figure 3:
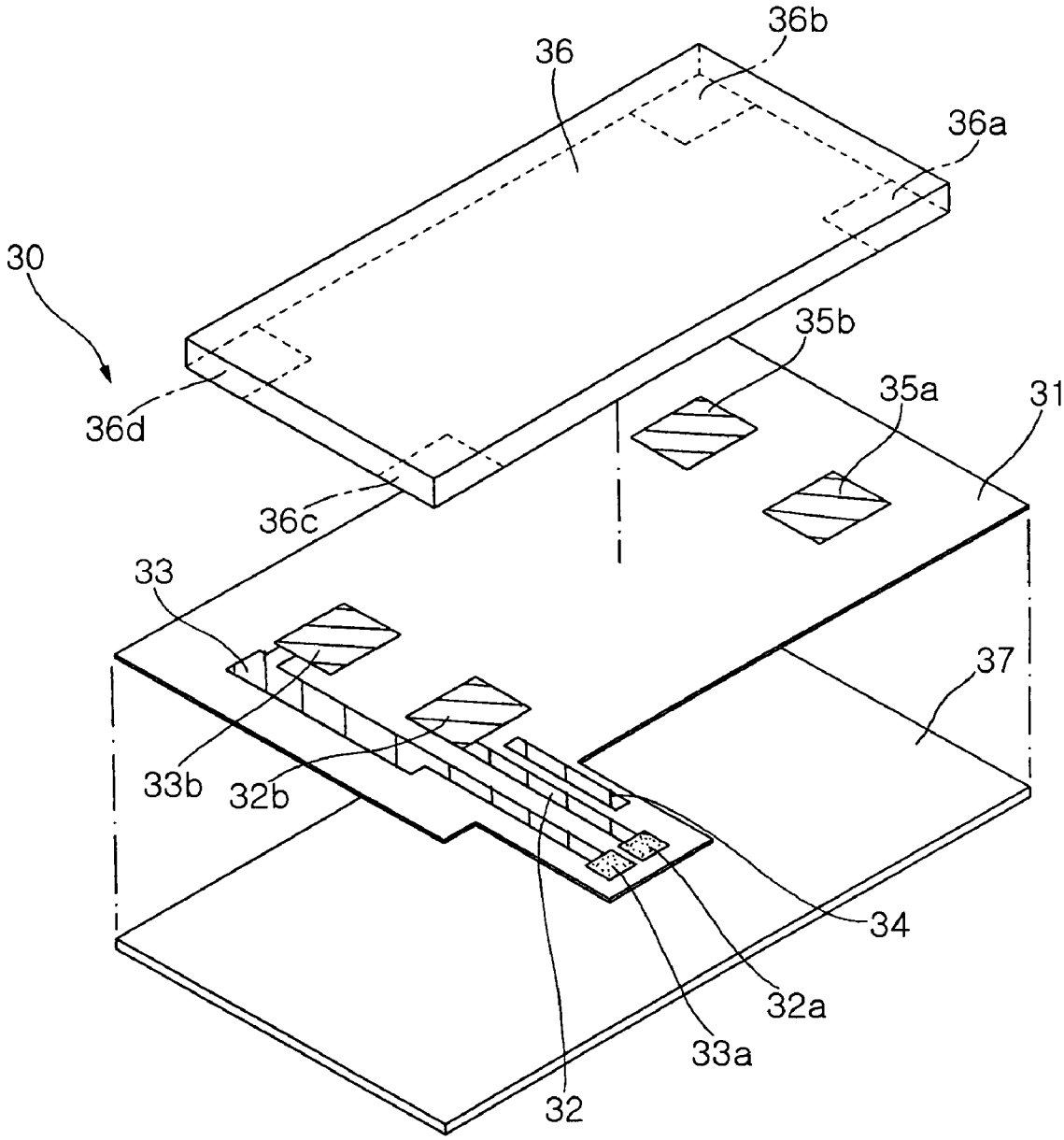
FIG. 3 is an exploded perspective view illustrating a construction of an antenna module according to the present invention.

FIG. 3 is an exploded perspective view illustrating a construction of an antenna module according to the present invention. Referring to FIG. 3, the antenna module 30 according to the present invention includes a substrate 31 made of non-conductive flexible material and an antenna element 36 mounted on the substrate 31.

On the substrate 31, a ground line 33 for grounding the antenna element 36, a feeder line 32 formed of conductive material at a predetermined position on the substrate 31 to supply current to the antenna element 36, a passive line 34 in parallel with the feeder line, adjusting impedance via electric coupling with the feeder-line 32, without being connected to a feeder part 36*c* or a ground part of the antenna element 36, and fixing pads 35*a* and 35*b* for fastening the antenna element 36 are formed.

The antenna module 36 mounted on the substrate 31 may take any form as long as it is mountable on the upper part of the substrate via die-bonding. In terms of size, an antenna element in a miniaturized form of chip is preferable, for example, a multi-layer chip antenna and a flat inverted F-type antenna. More broadly, a flat-type antenna with microstrip formed on a predetermined size of substrate may be included. At one end of the underside of the antenna element 36, the feeder part 36*c* supplied with current, and the ground part 36*d* for grounding the antenna element 36 are formed. Also, at the other end of the underside of the antenna element 36, first and second fixing parts 36*a* and 36*b* are formed in a longitudinal direction to fasten the antenna element 36 to the substrate 31. Here, the first fixing part 36*a* is fastened to the first fixing pad 35*a*, and the second fixing part 36*b* is fastened to the second fixing pad 35*b*. In addition, in the antenna element 36, a radiation part (not shown) for operating with the current supplied from the feeder 36*c*. The radiation part may be provided in diverse forms so as to obtain desired radiation characteristics depending on the type of antenna element 36.

At one end of the ground line 33, a ground pad 33*b* is formed to be connected to the ground part 36*d* of the antenna element 36 when the antenna element 36 is mounted on the substrate 31. In addition, at one end of the feeder line 32, a feeder pad 33*b* is formed to be connected to the feeder part 36*c* when the antenna element 36 is mounted on the substrate 31. Moreover, in the antenna module 30 according to the present invention, when the antenna element 36 is mounted on the substrate 31 made of flexible material, they may not be completely adhered to each other or may be detached from each other. In order to solve such problems, a fixing plate 37 having a predetermined hardness can be attached to the underside of the substrate 31 corresponding to the position of the antenna element 35. The fixing plate 37 should be made of non-conductive, non-metallic material so as not to change the characteristics of the antenna element 36.

The antenna module 30 with the above described construction is basically installed on the outer part of the wireless electronic device assembly (or printing circuit board), and only the feeder line 32 of the antenna module 30 is mounted on the assembly, decreasing the actual occupying space on the wireless electronic device assembly. Thus, the antenna module 30 is folded without distortion of impedance matching, maintaining the antenna characteristics while enhancing degree of freedom of disposition as the antenna module 30 is installed in the wireless electronic device.

In order to realize the above, the substrate 31 having the lines 32 to 34 made of conductors thereon for inputting, and outputting signals to and from the antenna element 36, grounding and impedance matching, is flexible and non-conductive, thereby improving a degree of freedom of disposition outside the wireless electronic device assembly. That is, as the substrate 31 is freely foldable or bendable, the substrate 31 may be bent and disposed on the upper or side surface of the assembly. At this time, an additional fixing member may be provided to fix the radiation direction of the antenna element 36, which will be explained hereinbelow with reference to another embodiment.

In order to obtain flexibility, the substrate 31 may be made of reversible material such as polymer and flexible material, and irreversible material such as polyimide, polyester, and glass epoxy. In addition, the structure may be realized in a single-layer substrate composed of one from the above group or a multi-layer substrate composed of sheets made of one or more of above materials adhered to one another with an organic adhesive.

Each end of the feeder line 32 and the ground line 33 is respectively connected to the feeder pad 32*b* and the ground pad 33*b* formed on the installation position of the antenna element 36, and come in contact with the feeder part 36*c* and the ground part 36*d* of the antenna element 36. The other ends of the feeder line 32 and the ground line 33 have joint portions (e.g. solder) 32*a* and 33*a* for mounting the antenna module 30 on the wireless electronic device assembly.

In addition to the feeder line 32 and the ground line 33, the antenna module 30 according to the present invention further includes a predetermined length of passive line 34 which is a conductive line in parallel with the feeder line 32. The passive line 34 forms electric coupling with the feeder line 32 which allows matching impedance of 50Ω even through the feeder line 32 is folded by a predetermined angle. That is, impedance matching between the antenna element 36 and the wireless electronic device is achieved, thereby minimizing signal loss.

Figure 2:
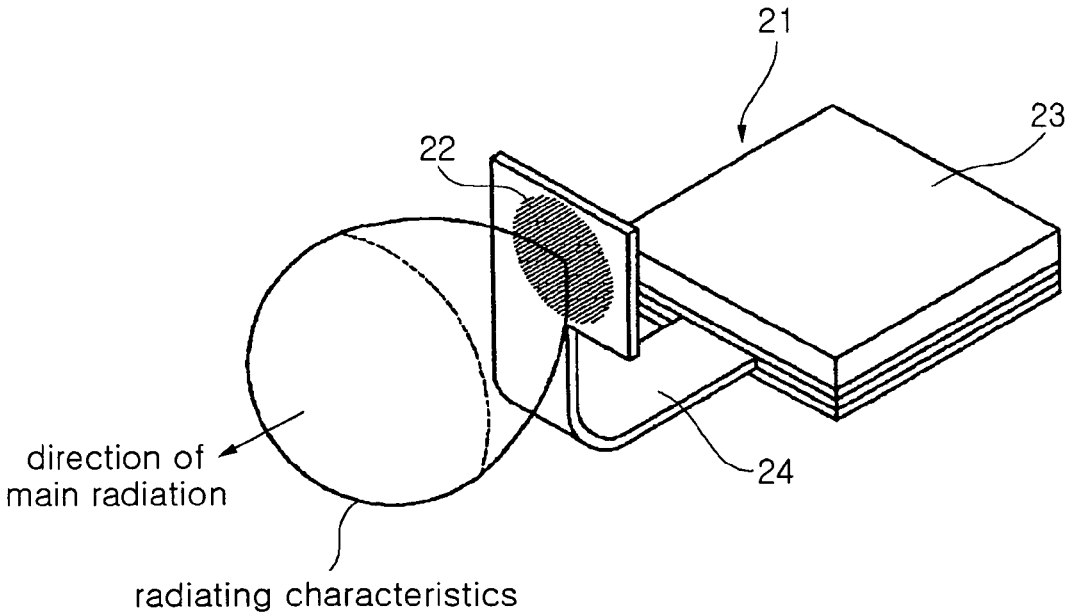
PRIOR ART FIG. 2
FIG. 2 is a perspective view illustrating a structure of a conventional antenna module.

If the passive line 34 is not provided as described above, each chip antenna comes to have different characteristics since each one is manufactured for a specific frequency, and thus each one requires a different feeder line. Further, as shown in FIG. 2, in case of vertical disposition of the antenna module, the feeder line is bent vertically, distorting the impedance matching.

The passive line 34 and the feeder line 32 are electrically coupled to generate coupling capacitance, which decreases the variation in impedance due to the variation in the position of the antenna element 36, enabling the transmission of signals without a loss. In other words, similar to the Co-planar Waveguide (CPW) feeding structure, impedance matching over a broad frequency bandwidth is possible.

Figure 4A:
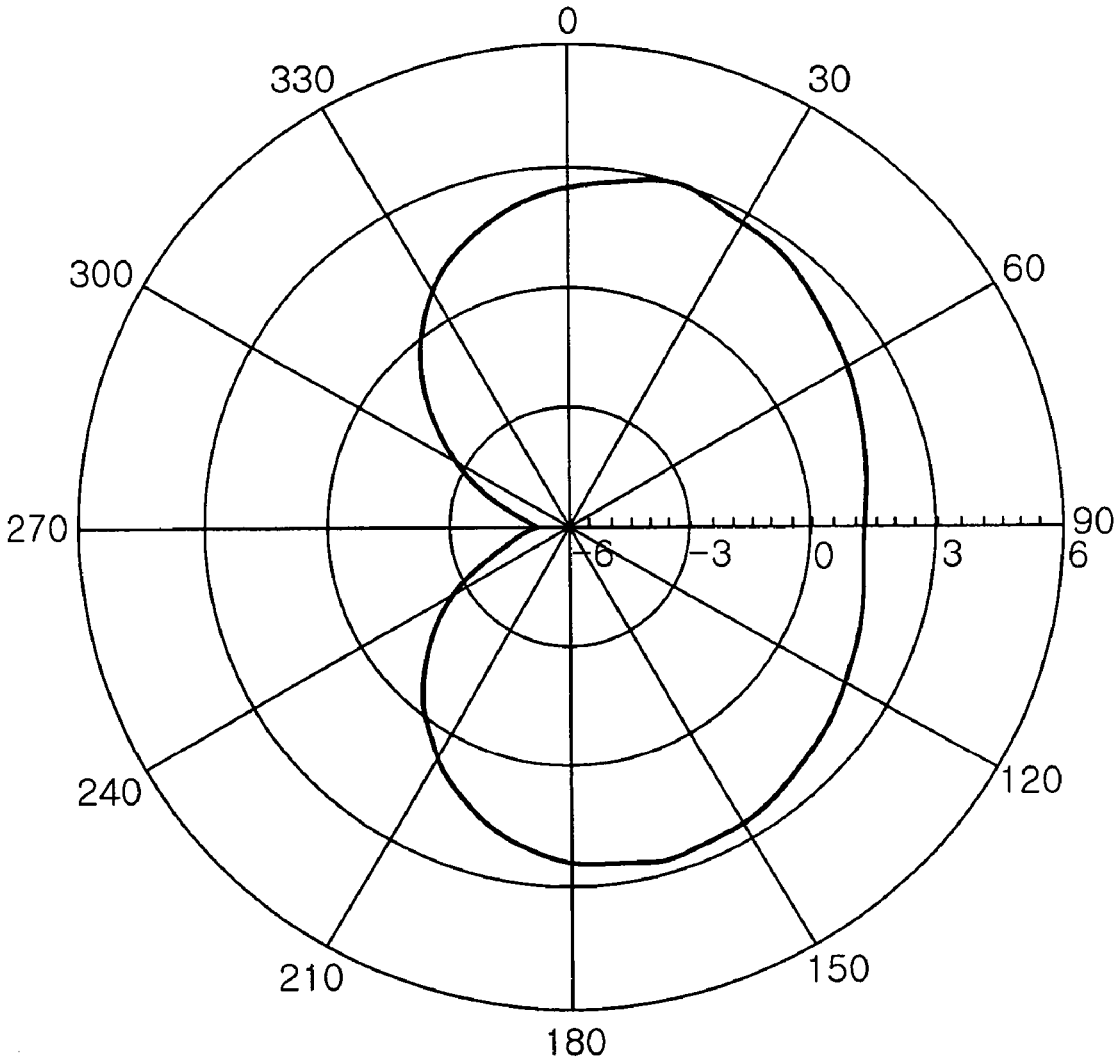
FIGS. 4*a* and 4*b* are graphs illustrating the radiation characteristics and Voltage Standing Wave Ratio (VSWR) of an antenna module with a passive line, respectively.
Figure 4B:
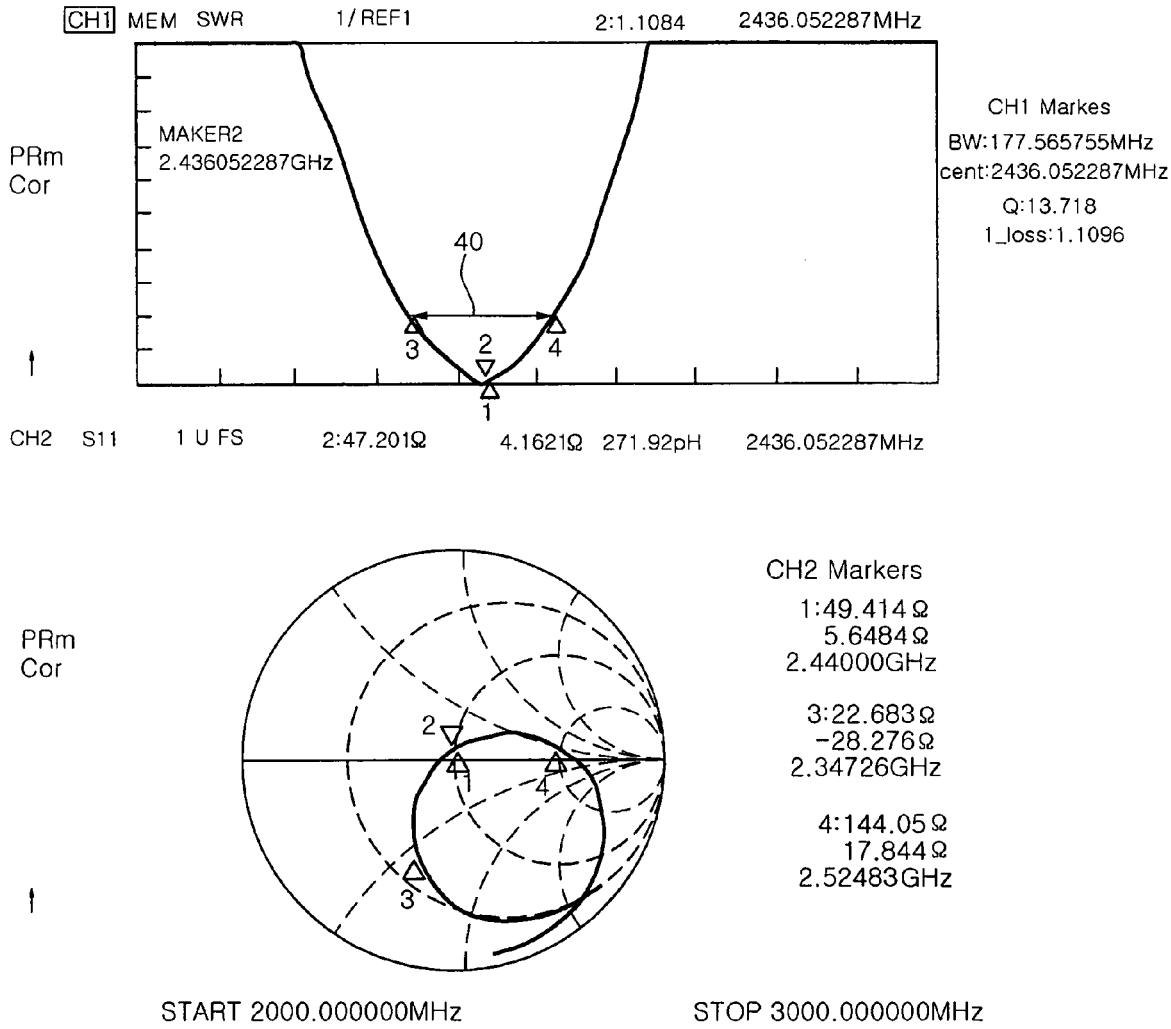

FIGS. 4*a* and 4*b* are graphs illustrating the radiation characteristics and Voltage Standing Wave Ratio (VSWR) of an antenna module with a passive line 34. First, FIG. 4*a* is a graph illustrating the radiation pattern of electric field (E-plane) of the antenna module with a passive line 34 illustrated in FIG. 3. Referring to FIG. 4*a*, the radiation pattern is even at all angles. But due to the effect of the ground surface, a null point is formed in the range near 270 degrees. FIG. 4*b* is a graph illustrating the Voltage Standing Wave Ratio (VSWR) of the antenna module with the passive line 34 of FIG. 3. Referring to FIG. 4*b*, the −6 dB bandwidth of the antenna module represents about 177 MHz (7%).

Figure 5:
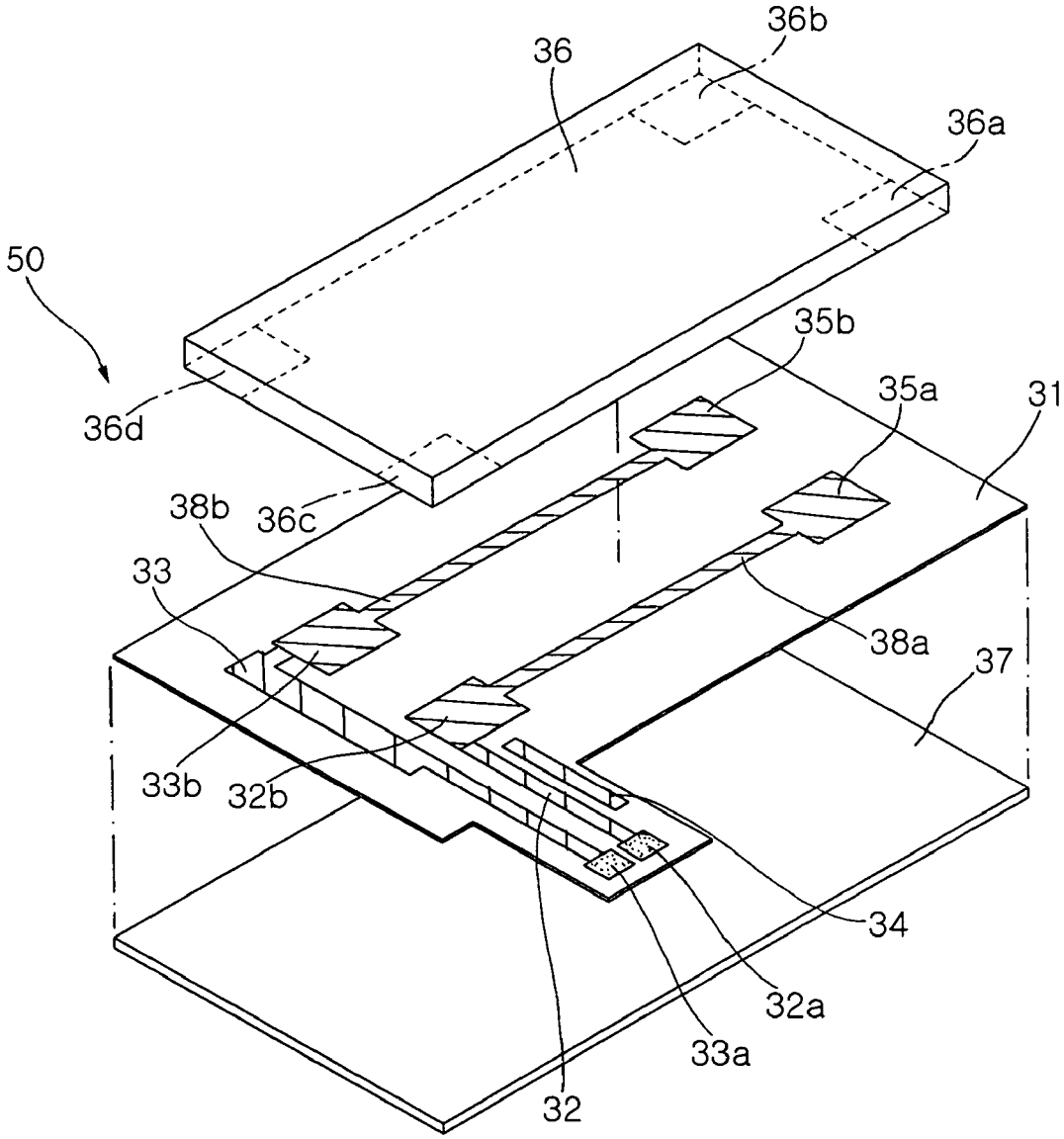
FIGS. 5 to 9 are perspective views illustrating a structure of an antenna module having a pad coupling element according to an embodiment of the present invention.

FIGS. 5 to 9 are diagrams illustrating a structure of an antenna module having a pad coupling element according to an embodiment of the present invention. Referring to FIG. 5, the antenna module 50 has the pad coupling element 38*a* and 38*b* composed of at least one conductive strip line between the feeder pad 32*b* and the first fixing pad 35*a*, and between the ground pad 33*b* and the second fixing pad 35*b* on the substrate 31.

Figure 6:
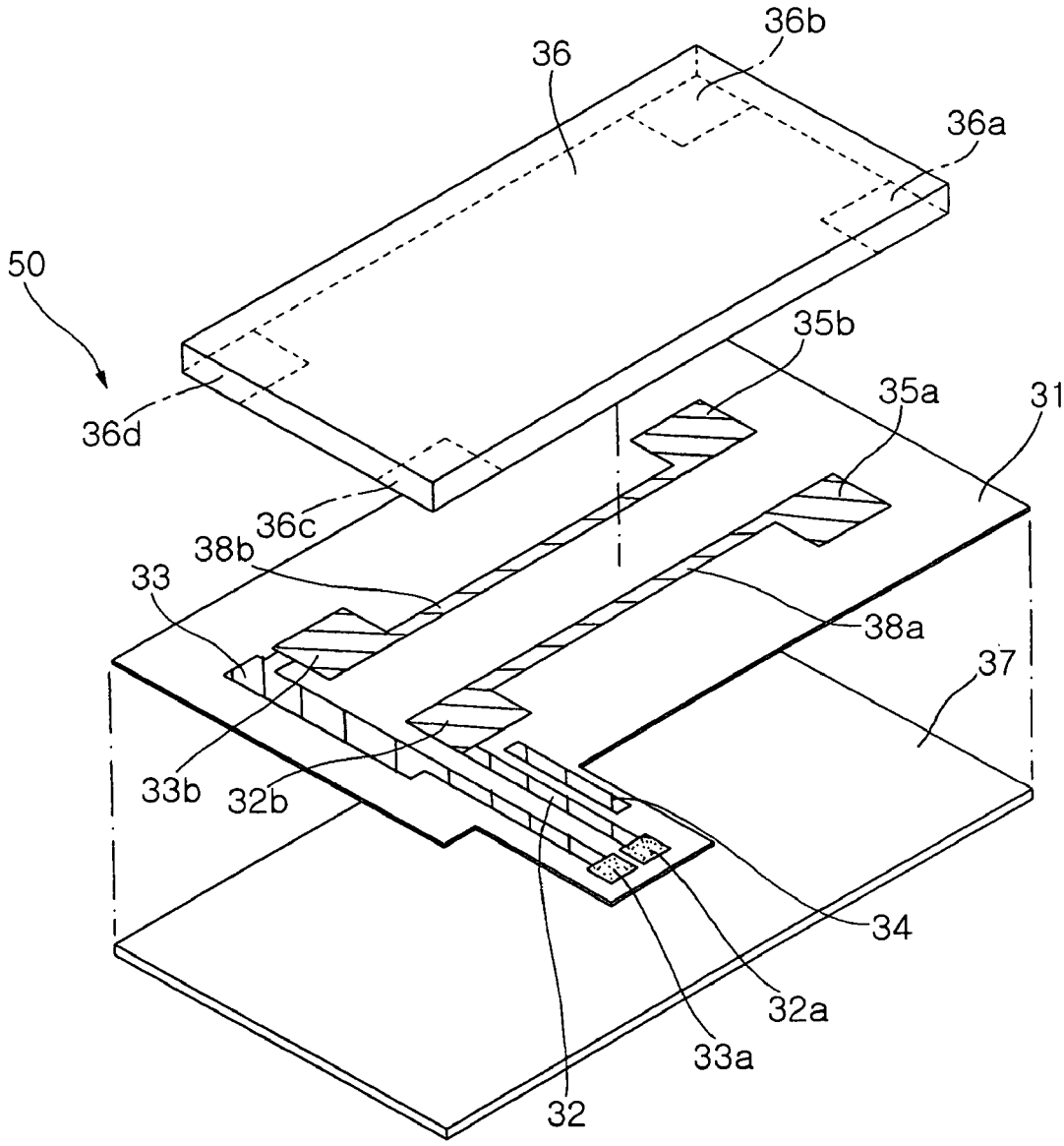
Figure 7:
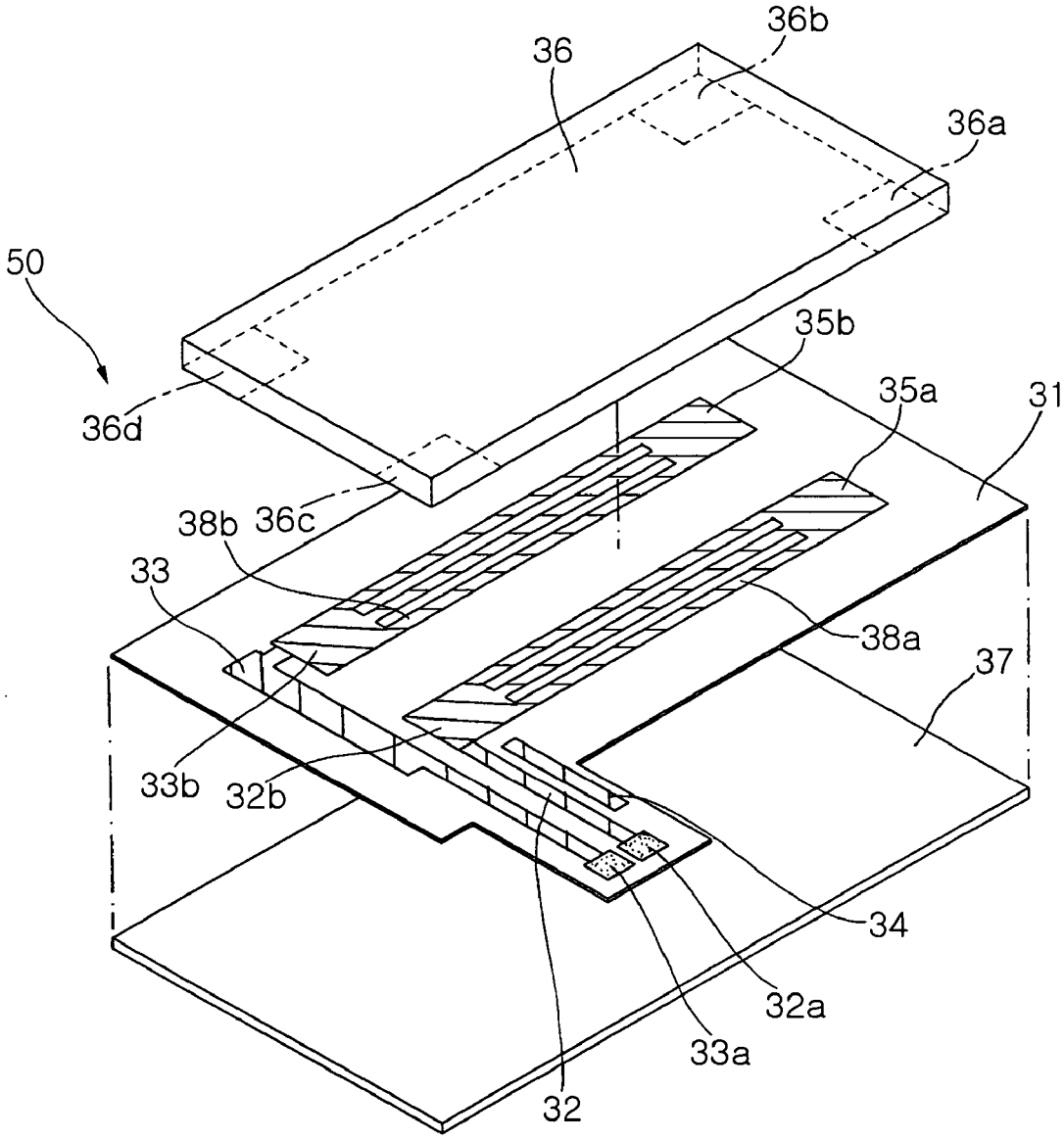
Figure 8:
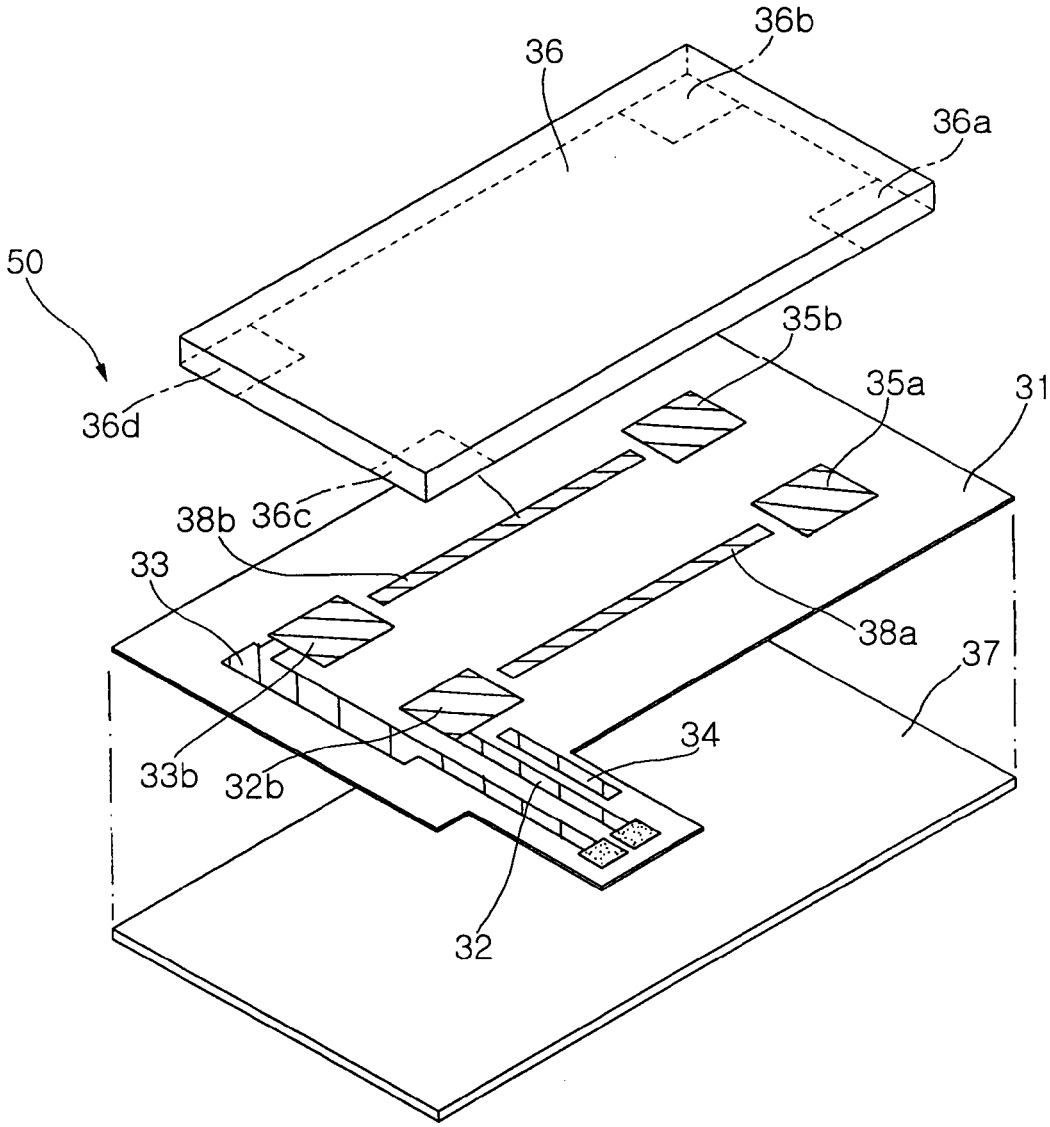

FIG. 5 illustrates a structure in which the pad coupling element 38*a* and 38*b* is formed in thin strip lines to be connected to the center of each end of the feeder pad 32*b*, the ground pad 33*b*, the first and second fixing pads 35*a* and 35*b*. As shown in FIG. 6, the pad coupling element 38*a* and 38*b* may be connected to the corners of each end of the feeder pad 32*b*, the ground pad 33*b*, and the first and second fixing pads 35*a* and 35*b*. In addition, as shown in FIG. 7, the pad coupling element 38*a* and 38*b* may be composed of a plurality of thin strip lines connecting between the feeder pad 32*b*, the ground pad 33*b*, and the first and second fixing pads 35*a* and 35*b*. Further, as shown in FIGS. 5 through 7, the pad coupling element 38*a* and 38*b* maybe connected to the feeder pad 32*b*, the ground pad 33*b*, and the first and second fixing pads 35*a* and 35*b* to be directly supplied with current. In addition, as shown in FIG. 8, the pad coupling element 38*a* may be disposed apart in a predetermined interval from the feeder pad 32*b*, and the first fixing pad 35*a* to be powered by electromagnetic coupling. The pad coupling element 38*b* may also be disposed apart from the ground pad 33*b* and the second fixing pad 35*b* to be powered by electromagnetic coupling.

Figure 9:
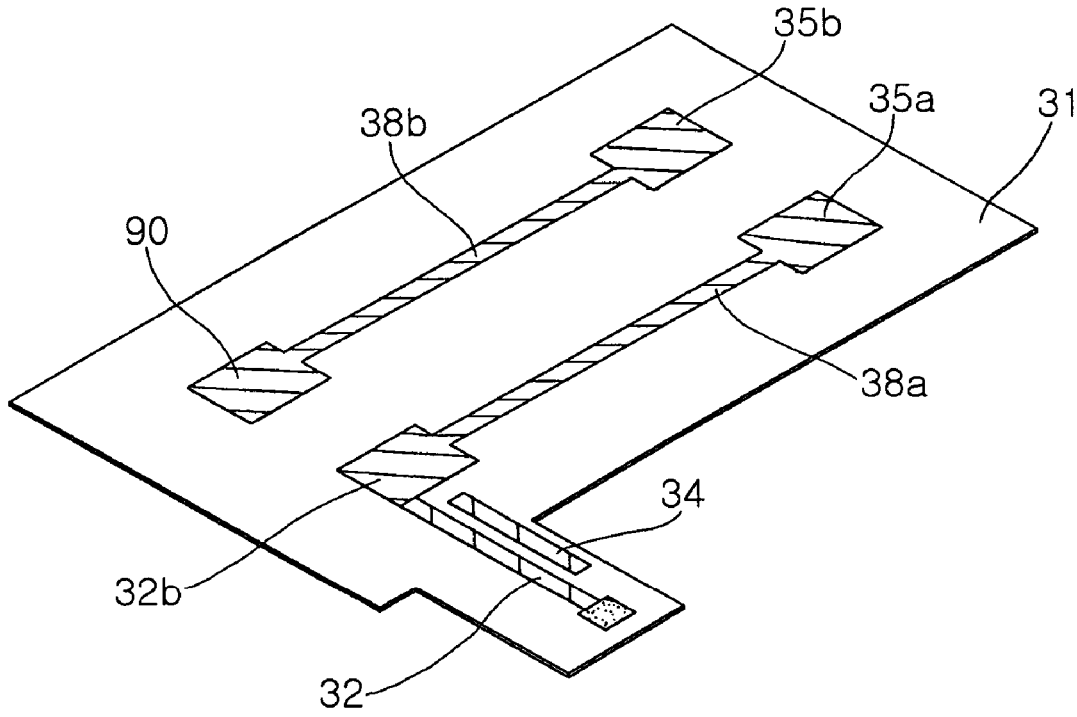

As shown in FIG. 9, in case of the antenna element 50 being a monopole type, the ground line 33 is not provded. Therefore, on the substrate 31, a third fixing pad 90 may be formed to fasten the antenna element 50 to the substrate 31, and a third fixing part (not shown) may be formed at a position corresponding to the position of the antenna element 50. The pad coupling elements 38*a* and 38*b* composed of at least one conductive strip line may be disposed between the feeder pad 32*b* and the first fixing pad 35*a*, and between the second fixing pad 35*b* and the third fixing pad 90.

In such a structure, a first resonance occurs by the current running through the feeder line 32 of the antenna module 50 to the radiation part (not shown) inside the antenna element 36. In addition, a second resonance occurs by the current supplied through the feeder line 32 to the pad coupling elements 38*a* and 38*b*. As a result, the interaction between the resonance by the radiation part of the antenna element 36 and the resonance by the pad coupling elements 38*a* and 38*b* allows obtainment of a broad bandwidth, enhancing radiation characteristics.

Figure 10A:
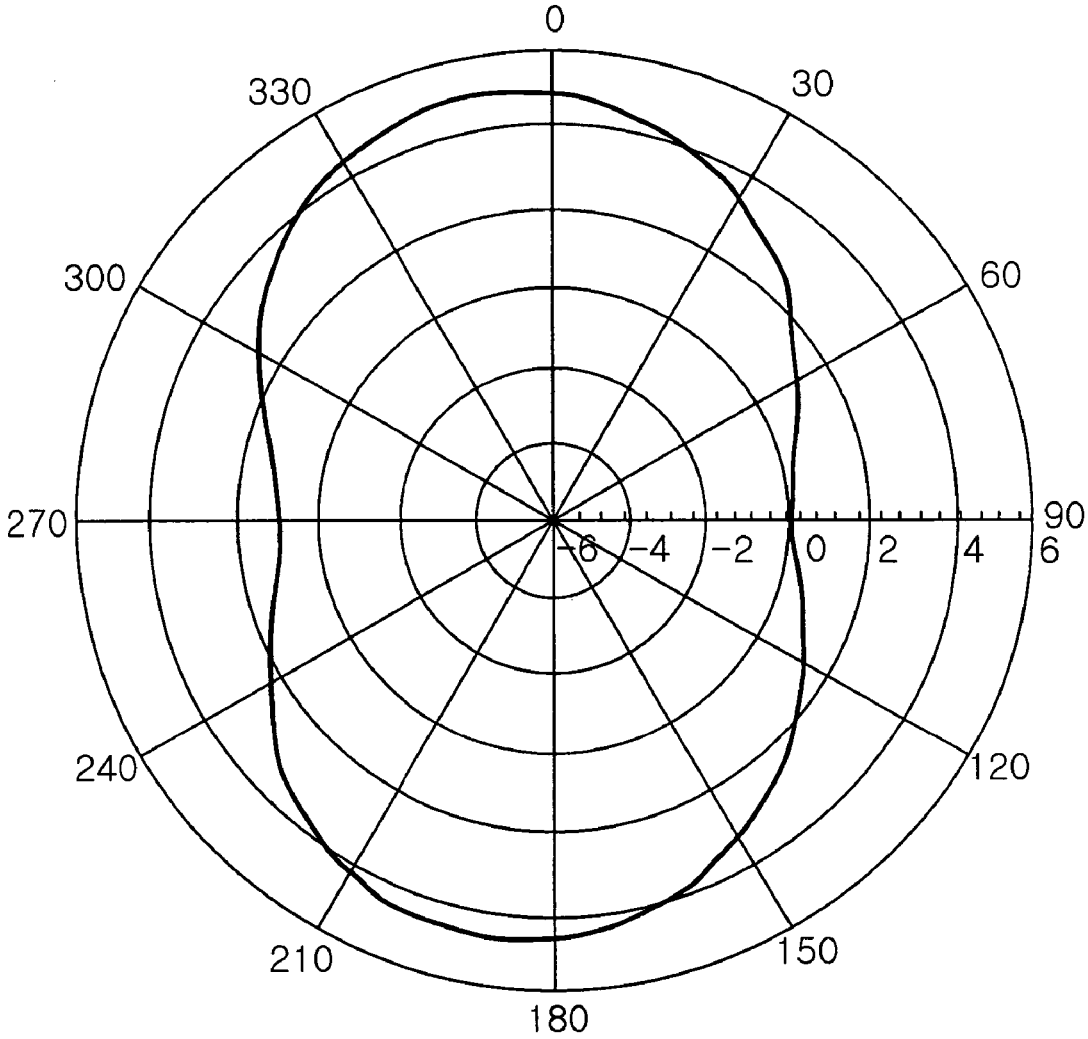
FIGS. 10*a* and 10*b* are graphs illustrating the radiation characteristics and the Voltage Standing Wave Ratio (VSWR) of the antenna module with the pad coupling element, respectively.
Figure 10B:
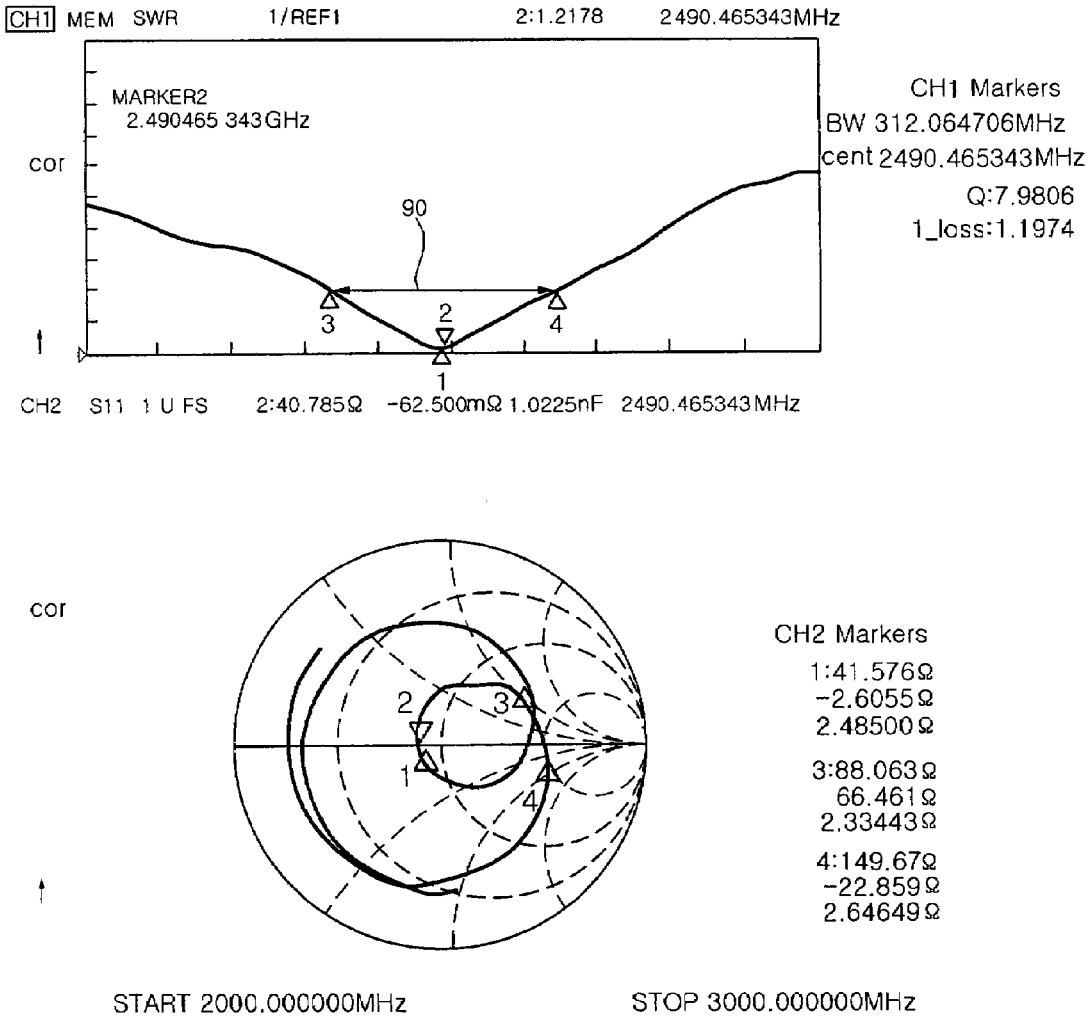

FIGS. 10*a* and 10*b* are graphs respectively illustrating the radiation characteristics and the Voltage Standing Wave Ratio (VSWR) of the antenna module with the pad coupling element. FIG. 10*a* is a diagram illustrating the radiation pattern of E-plane of the antenna module with the pad coupling elements 35*a* and 35*b* as in FIG. 5. Referring to FIG. 10*a*, an even radiation pattern is exhibited in all angles of the antenna, and it is noticeable that the maximum gain of the antenna increases up to 5 dBi or more. FIG. 10*b* is a diagram illustrating the Voltage Standing Wave Ratio (VSWR) of the antenna module with the pad coupling element 35*a* and 35*b* as in FIG. 5. Referring to FIG. 10*b*, it is noticeable that the −6 dB bandwidth 90 of the antenna module is about 344 MHz (14%), showing the increase in the bandwidth.

Figure 11:
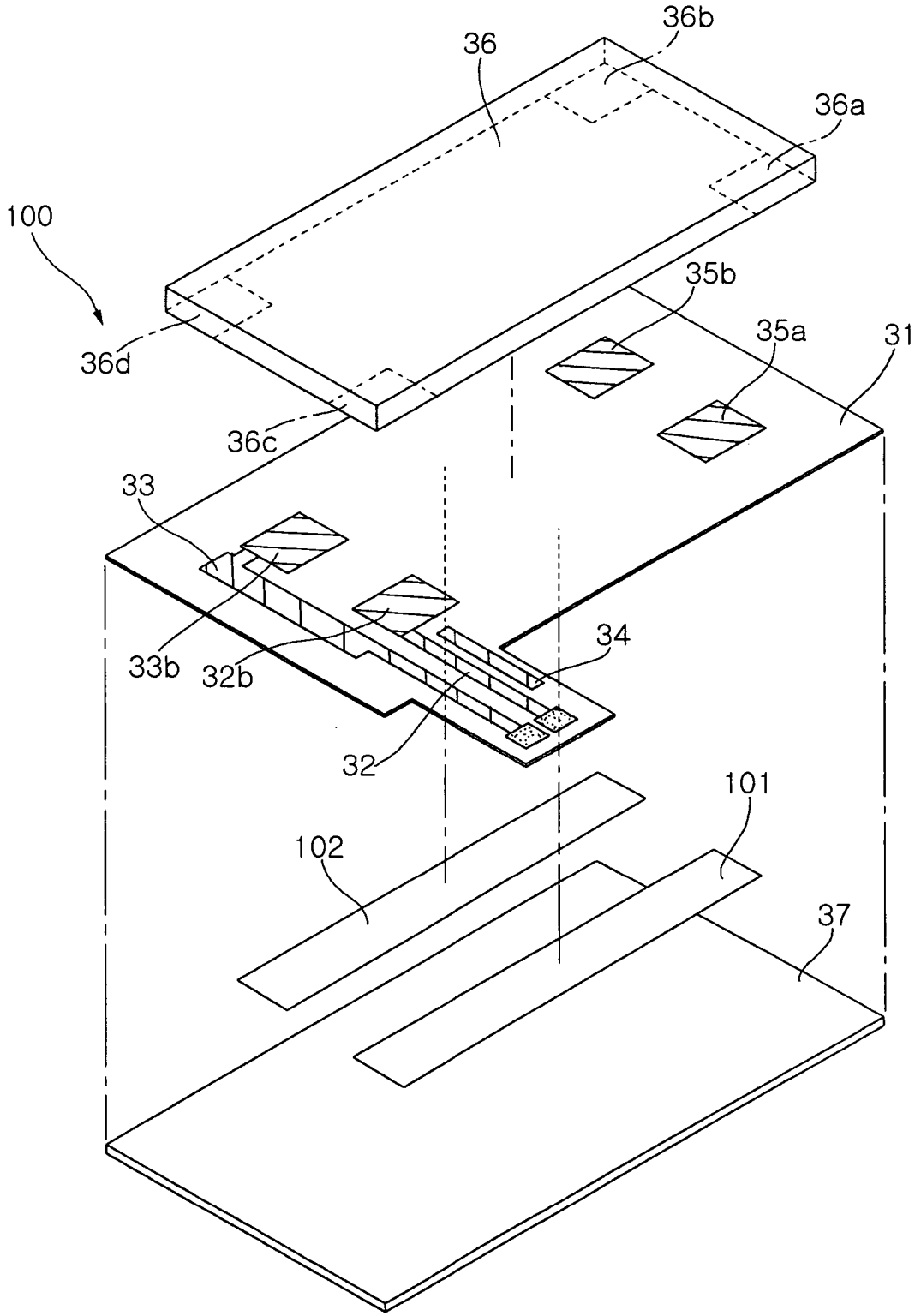
FIG. 11 is an exploded perspective view illustrating a structure of an antenna module having a lower coupling element according to an embodiment of the present invention.

FIG. 11 is an exploded perspective view of a construction of an antenna module with a lower coupling element according to an embodiment of the present invention. Referring to FIG. 11, in accordance with the embodiment of the invention, the antenna module 100 has the lower coupling element 101 and 102 formed of conductive strip lines on the underside of the substrate 31. A first lower coupling elements 101 has an end disposed below the feeder pad 32*b* and has the other end below the first fixing pad 35*a*. In addition, a second lower coupling element 102 has an end disposed below the ground pad 33*b* and has the other end below the second fixing pad 35*b*. In such a structure, a first resonance occurs by the current running through the feeder line 32 of the antenna module 50 to the radiation part (not shown) inside the antenna element 36. Also, the current is supplied to the lower coupling element 101 and 102 via electromagnetic coupling by the current running through the feeder line 32, and a second resonance occurs by the current supplied to the lower coupling elements 101 and 102. As a result, the interaction between the resonance by the radiation part of the antenna element 36 and the resonance by the lower coupling elements 101 and 102 allows a broad bandwidth as well as enhanced radiation characteristics.

Moreover, the lower coupling elements 101 and 102 may be directly connected to the ground pad 32*b* and the fixing pad 33*b* through vias formed in the substrate. In this case, current may be directly supplied to the lower coupling element 101 through the feeder pad 32*b* and to the lower coupling element 102 through the ground pad 33*b*. Thus, the interaction between the resonance by the radiation part of the antenna element 36 and the resonance by the lower coupling elements 101 and 102 allows a broader bandwidth and enhanced radiation characteristics.

FIG. 11 illustrates a structure of an antenna module 100 with only the lower coupling elements 101 and 102 on the underside of the substrate 36. But the pad coupling element 38*a* and 38*b* may also be disposed on the upper surface of the substrate 36 with the lower coupling element 101 and 102 on the underside of the substrate 36 at the same time. In addition, the antenna module 100 may further include a non-conductive fixing plate 37, having a predetermined degree of hardness, installed on the underside of the substrate 31 with the antenna element 36 to support the antenna element 36.

Figure 12:
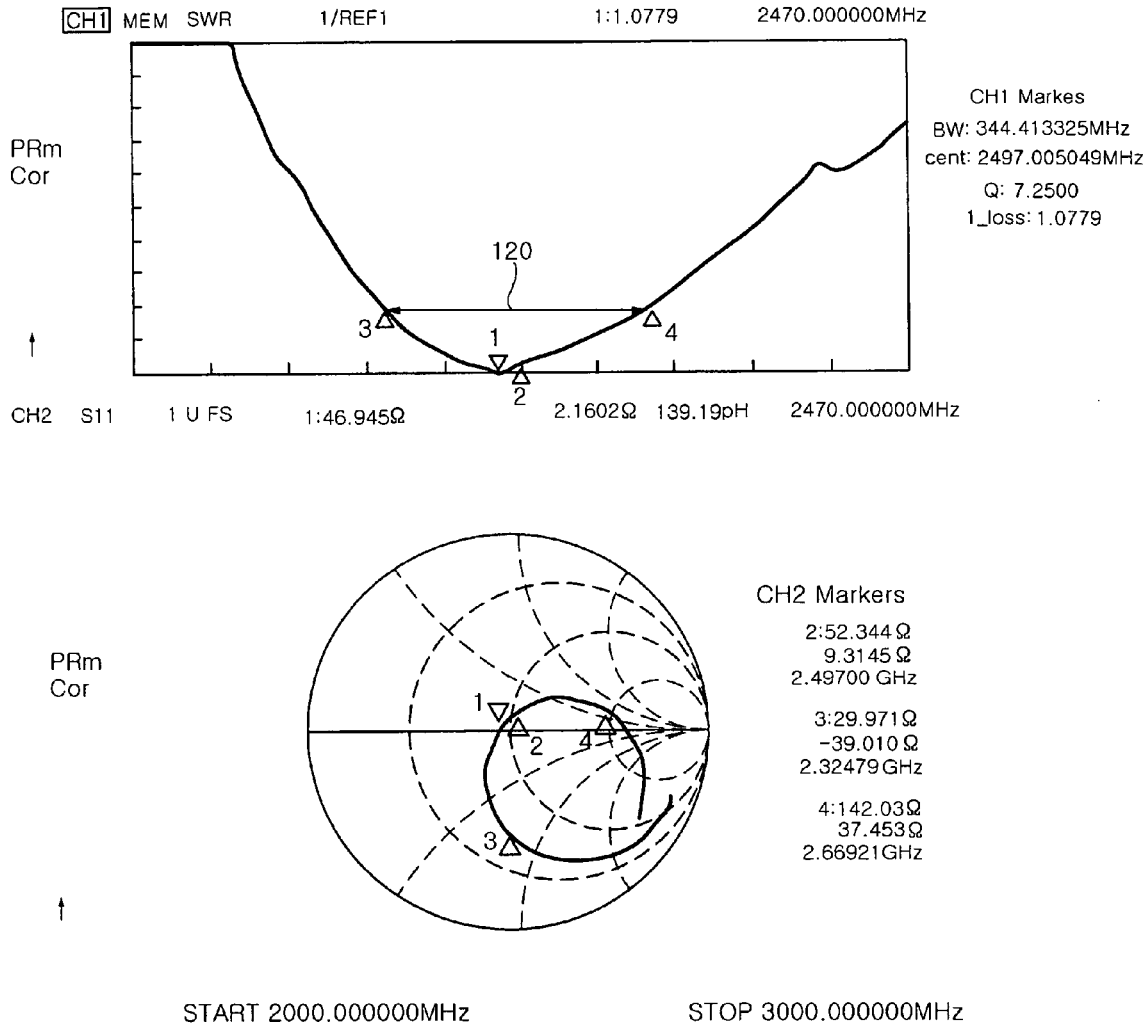
FIG. 12 is a graph illustrating the Voltage Standing Wave Ratio (VSWR) of the antenna module having the lower coupling elements.

FIG. 12 is a graph illustrating the Voltage Standing Wave Ratio (VSWR) of the antenna module with the lower coupling element according to the present invention. Referring to FIG. 12, in the antenna module 100 with the lower coupling element, −6 dB bandwidth 120 is about 312 MHz (12.5%), showing the increase in the bandwidth. In addition, the antenna module 100 with the lower coupling element exhibited an even radiation pattern in all angles and high antenna gain, similar to the antenna module with the pad coupling element 38*a* and 38*b*.

The antenna module 30, 50 and 100 may be installed outside the wireless electronic device assembly. The mounting structures of the antenna module 30, 50 and 100 on the wireless electronic device assemblies will be explained with references to FIGS. 13*a* through 13*c*.

Figure 13A:
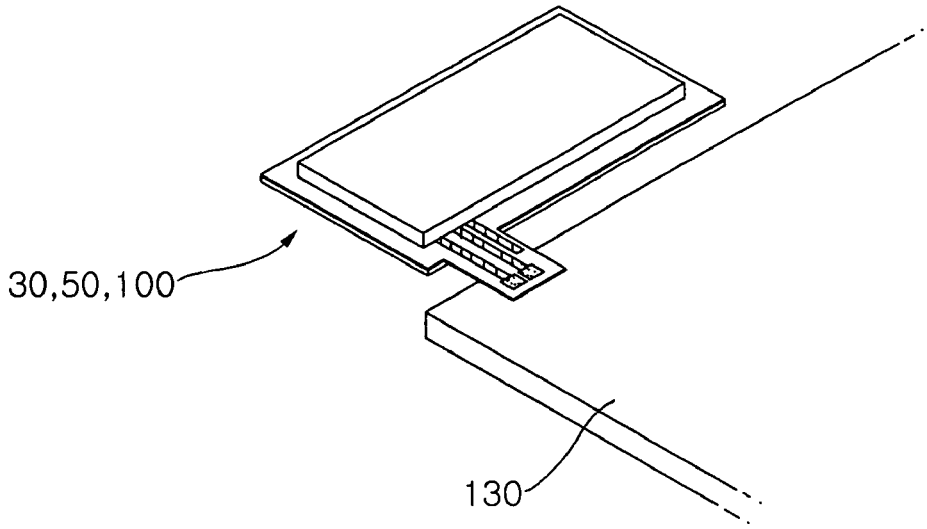
FIGS. 13*a* to 13*c* are perspective views illustrating examples of the antenna module according to the present invention installed in a wireless electronic device assembly.

Referring to FIG. 13*a*, the antenna modules 30, 50 and 100 have the joint portions 32*a* and 33*a* mounted on the printing surface of the circuit of the wireless electronic device assembly by soldering. At this time, it is preferable that the joint portions 32*a* and 33*a* are mounted in the left side on the upper surface of the assembly 130, and the orientation may be possible in all 360 degrees about the assembly 130, and therefore, the position may be set in consideration of the design and usage orientation of the wireless electronic device.

As shown in FIG. 13*a*, the antenna module 30, 50 and 100 has flexibility which allows being folded inwardly toward the assembly 130, and thus, the antenna module 30 may be flexibly accommodated when packaging the wireless electronic device.

At this time, it is preferable that the radiation direction of the antenna module 30, 50 and 100 faces upward or sideways rather than toward the assembly 130, and in order to fix the radiation direction of the antenna modules 30, 50 and 100, the antenna module 30, 50 and 100 may be fixed using an additional fixing structure.

Figure 13B:
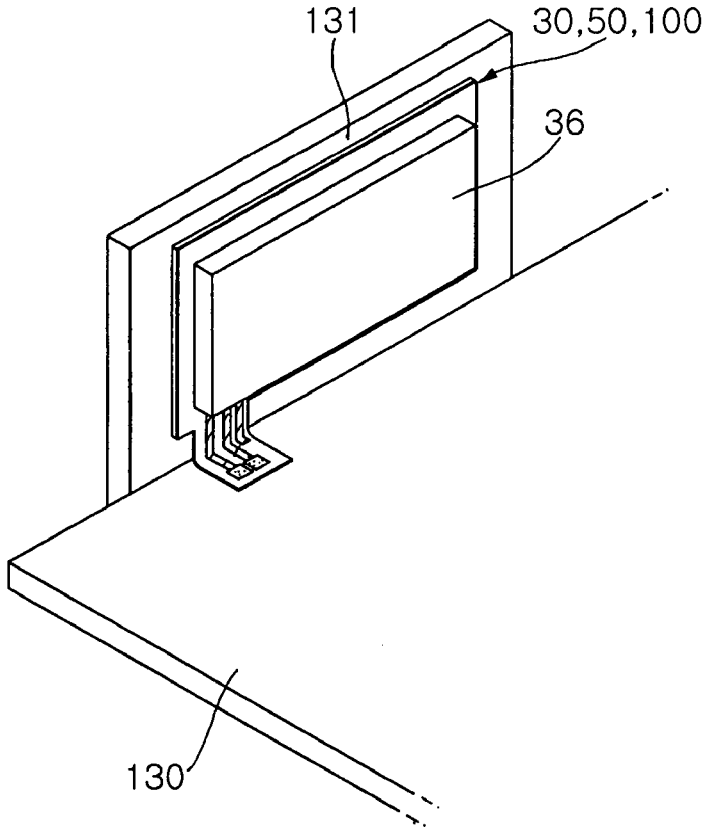
Figure 13C:
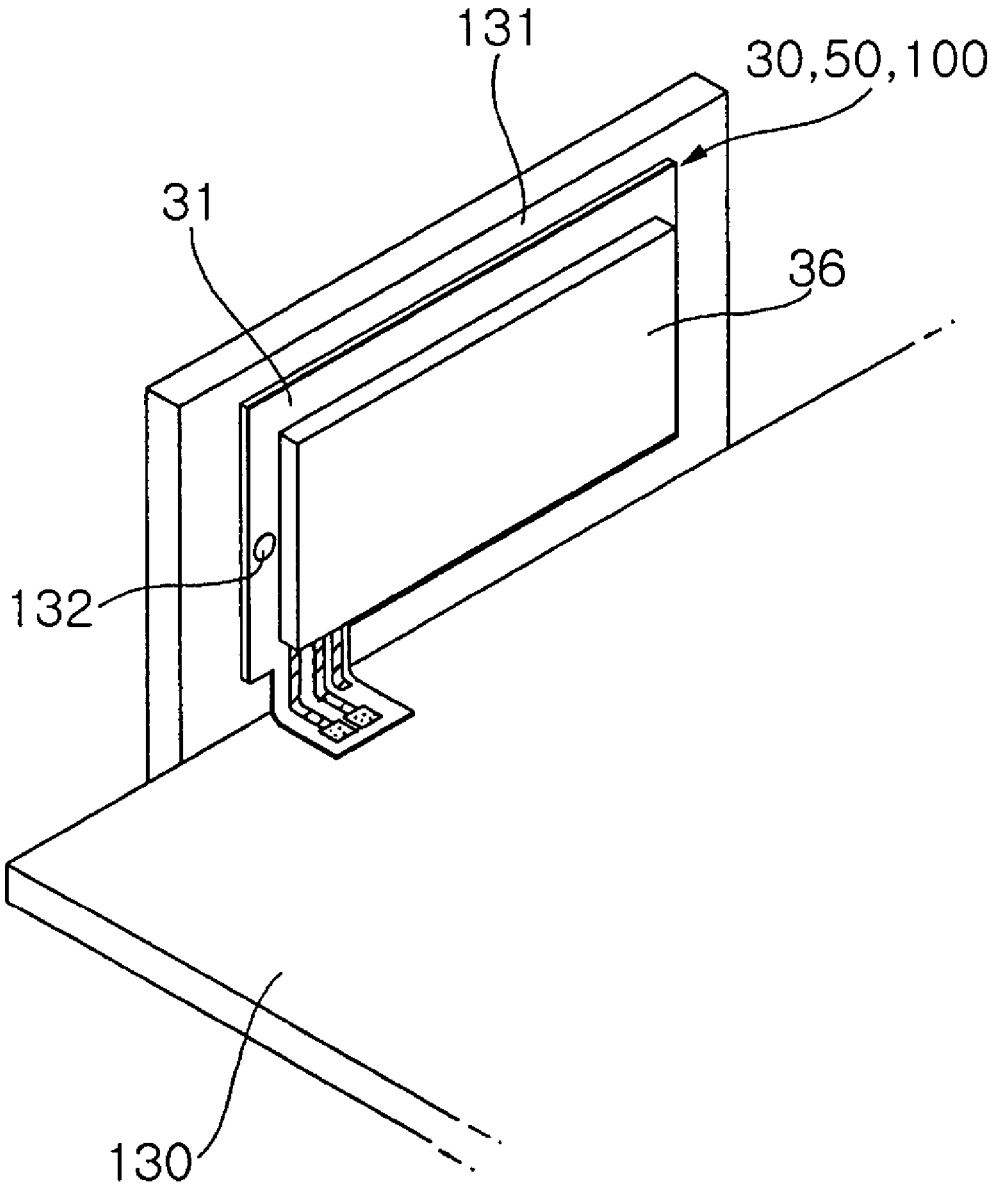

FIGS. 13*b* and 13*c* show the examples of fixing structures of the antenna module 30, 50 and 100, mounted on the wireless electronic device assembly 130, in perpendicular to the upper surface of the wireless electronic device assembly 130. Referring to FIG. 13*b*, the joint portions of the antenna module 30, 50, and 100 are bonded to the outer edge of the circuit-printed surface the wireless electronic device assembly 130 by soldering. In addition, a predetermined size of side wall 131 is formed on the side surface of the assembly 130 to support the antenna module 30, 50 and 100. The surface of the antenna module on which the antenna element 36 is disposed is attached to the side wall 131 with organic material. Thereby, the main radiation direction of the antenna element 36 faces sideways with respect to the wireless electronic device assembly 130.

Referring to FIG. 13*c*, a side wall 131 is formed at the side surface of the wireless electric device assembly to support the antenna module 30, 50 and 100 in the same manner as in the above. At this time, a fixing pin 132 is provided at a predetermined position on the side wall 131, and a hole is formed at the position on the substrate 31 of the antenna module 30, 50, 100 corresponding to the fixing pin 132. The fixing pin 132 is inserted into the hole, fixing the antenna module 30, 50, and 100 to the side wall 131. At this time, the joint portions 32*a* and 33*a* of the antenna module 30, 50, and 100 are bonded to the outer surface of the wireless electronic device assembly 130.

In addition to the above described examples, there may be a reception groove formed in the wireless electronic device to receive the antenna module 30, 50, and 100 whose joint portions 32*a* and 33*a* are bonded to the wireless electronic device assembly 130.

As described above, in case that the antenna module 30, 50 and 100 is positioned outside the wireless electronic device assembly 130, the mounting space of the antenna module 30, 50 and 100 on the wireless electronic device assembly 130 is reduced, increasing design flexibility of other parts of the wireless electronic device, and thus solving the problems related to limited mounting position due to LCDs, cameras, and speakers mounted in the device and to maintenance of characteristics of the antenna.

As set forth above, in the present invention, the antenna element is disposed outside of the wireless electronic device assembly, reducing the space for mounting the antenna on the wireless electronic device assembly, thereby minimizing the effects from other elements within the wireless electronic device.

Moreover, the present invention uses the flexible substrate to increase a degree of freedom in disposition of the antenna module, and adjusts impedance via the feeder line and the passive line, thereby allowing disposition of the antenna element in the device in a perpendicular angle without undermining impedance matching. In addition, the present invention allows obtainment of an even radiation pattern in all angles of the antenna module with a broad bandwidth.

Furthermore, in the present invention, only the feeder line and the ground line are mounted on the wireless electronic device assembly, and the actual occupying space of the antenna module can be in the unused space in consideration of the packaging of the wireless electronic device, thereby enhancing the miniaturization of the wireless electronic device.

While the present invention has been shown and described in connection with the preferred embodiments, it will be apparent to those skilled in the art that modifications and variations can be made without departing from the spirit and scope of the invention as defined by the appended claims.

What is claimed is:

1. An antenna module comprising:

a substrate made of non-conductive material having flexibility;

an antenna element, mounted at a predetermined position on the upper part of the substrate, having a feeder part at one end of the underside thereof to be supplied with current, a first fixing part at the other end of the underside thereof to fasten the antenna element to the substrate, and a radiation part operating in response to the supplied current;

a feeder line formed on the substrate to be connected to the feeder part of the antenna element, having a feeder pad formed at one end thereof;

a first fixing pad formed on the substrate to be connected to the first fixing part of the antenna element; and a pad coupling element comprising at least one conductive strip line which is disposed between the feeder pad and the first fixing pad, whereby a predetermined band of signals are processed via interaction between the resonance of the current running through the feeder line to the radiation part of the antenna element and the resonance of the current coming into the pad coupling element.

2. The antenna module according to claim 1, wherein the antenna element comprises a ground part at one end of the underside thereof for grounding the antenna element, and a second fixing part at the other end of the underside thereof, in a position opposed to the ground part, the substrate comprises a ground line having a ground pad at one end thereof to be connected to the ground part of the antenna element, and a second fixing pad formed in a position on the substrate where the second fixing part of the antenna element is mounted, and the pad coupling element comprises at least one conductive strip line disposed between the ground pad and the second fixing pad.

3. The antenna module according to claim 1 or 2, wherein the pad coupling element is directly connected to the feeder pad, ground pad, and fixing pad.

4. The antenna module according to claim 1 or 2, wherein the pad coupling element is disposed apart in a predetermined interval from the feeder pad, the ground pad, and the fixing pad to enable current supply via electromagnetic coupling.

5. The antenna module according to claim 1 or 2, further comprising a passive line formed in a predetermined length on the substrate to be in parallel with the feeder line.

6. The antenna module according to claim 1 or 2, further comprises a lower coupling element disposed on the underside of the substrate, in a longitudinal direction of the antenna element.

7. The antenna module according to claim 6, wherein the lower coupling element is directly connected to the feeder pad or ground pad through vias formed in the substrate.

8. The antenna module according to claim 1 or 2, wherein the substrate comprises a single-layer structure formed of reversible material including polymer and flexible metal, and irreversible material including polyimide, polyester and glass epoxy, or a multi-layer structure formed of the above materials adhered to one another with an organic adhesive.

9. The antenna module according to claim 1 or 2, wherein the antenna element is mountable on the upper surface of the substrate via die bonding.

10. A wireless electronic device comprising:

an antenna module including an antenna element mounted on a substrate made of flexible material, a conductive feeder line contacting at one end a feeder part of the antenna element and a ground line contacting one end ground part of the antenna element, each of the conductive feeder and ground lines having a joint portion at the end thereof, a conductive passive line formed in parallel with the feeder line, a fixing part formed on the substrate to fasten the antenna element to the substrate, and a coupling element disposed between the feeder line and the ground line; and an assembly of a plurality of elements constituting a circuit, supplying current via the feeder line to the antenna module, whereby the antenna module is mounted at a predetermined position of the assembly at the joint portions of the feeder line and the ground line, and disposed outside of the assembly.

11. The wireless electronic device according to claim 10, wherein the joint portions of the feeder line and the ground line of the antenna module are connected to the upper part of the outer part of the assembly.

12. The wireless electronic device according to claim 10, further comprising a predetermined size of side wall at a side surface of the assembly, with the antenna element of the antenna module attached to the side wall.

13. The wireless electronic device according to claim 10, wherein a predetermined size of side wall with a protruded fixing pin is formed at a side surface of the assembly, and a fastening hole is formed in a position corresponding to the fixing pin of the antenna module, so as to fasten the antenna module to the side wall.

* * * * *